US010494163B2

(12) United States Patent
Hadley

(10) Patent No.: US 10,494,163 B2
(45) Date of Patent: Dec. 3, 2019

(54) PADDED SHIPPING ENVELOPE ASSEMBLY AND METHOD OF MANUFACTURING SAME

(71) Applicant: Robert M. Hadley, Swanton, OH (US)

(72) Inventor: Robert M. Hadley, Swanton, OH (US)

( * ) Notice: Subject to any disclaimer, the term of this patent is extended or adjusted under 35 U.S.C. 154(b) by 46 days.

(21) Appl. No.: 15/844,698

(22) Filed: Dec. 18, 2017

(65) Prior Publication Data

US 2018/0170647 A1 Jun. 21, 2018

Related U.S. Application Data

(60) Provisional application No. 62/436,068, filed on Dec. 19, 2016.

(51) Int. Cl.
*B65D 81/03* (2006.01)

(52) U.S. Cl.
CPC ..... *B65D 81/03* (2013.01)

(58) Field of Classification Search
CPC .... B65D 81/03; B65D 81/025; B65D 81/027; B65D 81/022; B31B 2170/20; B31B 2150/00
USPC ..... 229/80.5
See application file for complete search history.

(56) References Cited

U.S. PATENT DOCUMENTS 3,948,436 A * 4/1976 Bambara ..... B65D 31/02 206/523
4,087,002 A * 5/1978 Bambara ..... B29C 65/18 206/523
4,193,499 A * 3/1980 Lookholder ..... B65D 81/027 206/524
4,620,633 A * 11/1986 Lookholder ..... B29C 44/185 206/523
5,273,361 A * 12/1993 Jillson ..... B32B 3/12 383/93
5,544,473 A * 8/1996 Maida ..... B65D 31/04 206/591
5,547,075 A * 8/1996 Hoogerwoord ..... B65D 81/03 206/204
6,109,440 A * 8/2000 Cliff ..... B65D 81/03 206/523
9,827,711 B2 * 11/2017 Wetsch ..... B32B 3/04
2006/0169753 A1 * 8/2006 Piucci ..... B31D 5/0073 229/68.1
2011/0192121 A1 * 8/2011 Kannankeril ..... B31D 5/0073 53/473

* cited by examiner

*Primary Examiner* — Corey N Skurdal
(74) *Attorney, Agent, or Firm* — MacMillan, Sobanski & Todd, LLC

(57) ABSTRACT

A padded shipping envelope is provided. The padded shipping envelope includes a folded, compressed bladder configured to form an interior bladder cavity. The interior bladder cavity is configured to receive items intended for shipment. The folded compressed bladder is formed from a compressed, self-expanding padding material disposed in an airtight flexible wrapper. A covering structure has an interior cavity configured to receive the folded, compressed bladder and a foldable sealing flap. The compressed padding material is configured to expand to a precompressed thickness upon the introduction of air and the folded, compressed bladder is sealed on three sides.

17 Claims, 4 Drawing Sheets

PADDED SHIPPING ENVELOPE ASSEMBLY AND METHOD OF MANUFACTURING SAME

RELATED APPLICATIONS

This application claims the benefit of U.S. Provisional Application No. 62/436,068, filed Dec. 19, 2016, the disclosure of which is incorporated herein by reference in its entirety.

BACKGROUND

A common shipping method includes the use of a padded mailer. Padded mailers are generally shipping envelopes that have a padding and/or insulation disposed on the interior surfaces of the mailer. The exterior surfaces of the mailer are typically formed with durable, abrasion-resistant materials, such as heavy paper or polymeric materials.

In certain instances, the padding and/or insulation disposed on the interior surfaces is constructed from a double-wall paper envelope with paper dunnage between the walls. In other instances, the padding disposed on the interior surfaces contains air cellular material or puffed materials such as the non-limiting example of foam peanuts.

Since the padding within the padded mailers can occupy a larger volume than non-padded mailers, in certain instances, the padded mailers can require a large storage space and can be expensive to deliver to the shipper. Consequently, padded mailers can have a relatively thin padding so that their size is both practical and economic. As a result, the protective capabilities of these padded envelopes can be limited.

It would be advantageous if padded mailers could be improved.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the padded shipping envelope assembly and method of manufacturing the padded shipping envelope assembly.

The above objects as well as other objects not specifically enumerated are achieved by a padded shipping envelope. The padded shipping envelope includes a folded, compressed bladder configured to form an interior bladder cavity. The interior bladder cavity is configured to receive items intended for shipment. The folded compressed bladder is formed from a compressed, self-expanding padding material disposed in an airtight flexible wrapper. A covering structure has an interior cavity configured to receive the folded, compressed bladder and a foldable sealing flap. The compressed padding material is configured to expand to a precompressed thickness upon the introduction of air and the folded, compressed bladder is sealed on three sides.

The above objects as well as other objects not specifically enumerated are also achieved by a method of manufacturing a padded shipping envelope assembly. The method includes the steps of forming a prefolded compressed bladder from a compressed, self-expanding padding material and disposing in an airtight flexible wrapper, applying an adhesive material to a major surface of the prefolded compressed bladder and folding the prefolded compressed bladder over onto itself such that the adhesive materials are engaged in a manner such that the folded, compressed bladder is maintained in a folded orientation, in the folded orientation, the folded compressed bladder forms an interior bladder cavity that is sealed on three sides and inserting the folded compressed bladder into a covering structure, thereby forming the padded shipping envelope assembly.

The above objects as well as other objects not specifically enumerated are also achieved by a folded, compressed bladder configured for use in a padded shipping envelope assembly. The folded compressed bladder includes a flexible wrapper and a compressed, self-expanding padding material disposed within the flexible wrapper. An adhesive material is applied to a major side of the flexible wrapper and configured to retain the folded, compressed bladder in a folded orientation. The folded, compressed bladder is sealed on three sides.

Various aspects of the padded shipping envelope assembly and method of manufacturing the padded shipping envelope assembly will become apparent to those skilled in the art from the following detailed description of the illustrated embodiments, when read in light of the accompanying drawings.

DETAILED DESCRIPTION

Figure 1:
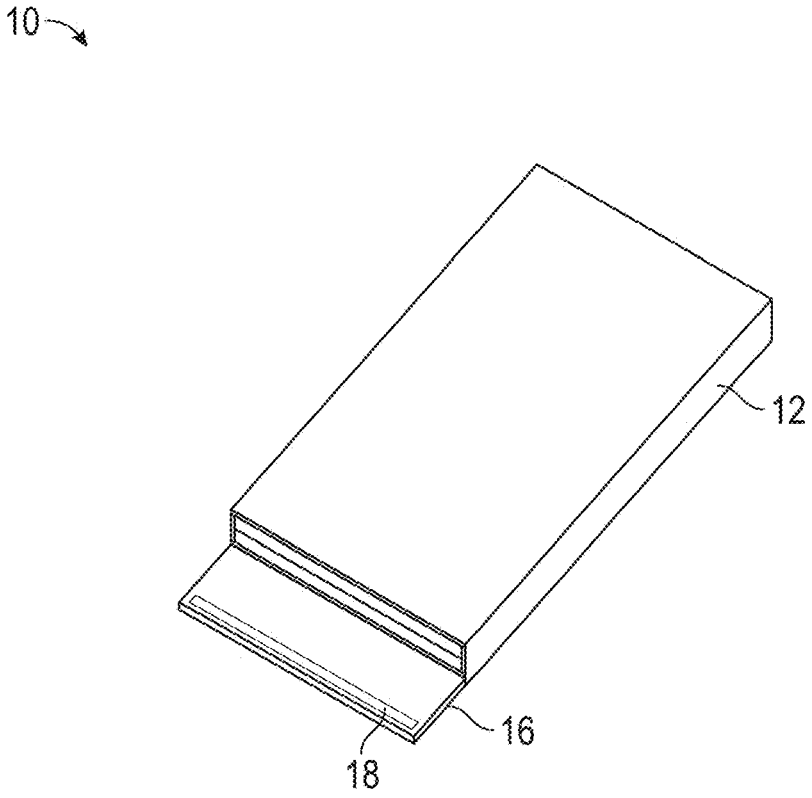
FIG. 1 is a perspective view of a padded shipping envelope assembly.

The padded shipping envelope assembly and method of manufacturing the padded shipping envelope assembly will now be described with occasional reference to the specific embodiments. The padded shipping envelope assembly and method of manufacturing the padded shipping envelope assembly may, however, be embodied in different forms and should not be construed as limited to the embodiments set forth herein. Rather, these embodiments are provided so that this disclosure will be thorough and complete, and will fully convey the scope of the padded shipping envelope assembly and method of manufacturing the padded shipping envelope assembly to those skilled in the art.

Unless otherwise defined, all technical and scientific terms used herein have the same meaning as commonly understood by one of ordinary skill in the art to which the padded shipping envelope assembly and method of manufacturing the padded shipping envelope assembly belongs. The terminology used in the description of the padded shipping envelope assembly and method of manufacturing the padded shipping envelope assembly herein is for describing particular embodiments only and is not intended to be limiting of the padded shipping envelope assembly and method of manufacturing the padded shipping envelope assembly. As used in the description of the padded shipping envelope assembly and method of manufacturing the padded shipping envelope assembly and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the padded shipping envelope assembly and method of manufacturing the padded shipping envelope assembly. Notwithstanding that the numerical ranges and parameters setting forth the broad scope of the padded shipping envelope assembly and method of manufacturing the padded shipping envelope assembly are approximations, the numerical values set forth in the specific examples are reported as precisely as possible. Any numerical values, however, inherently contain certain errors necessarily resulting from error found in their respective measurements.

The term "envelope", as used herein, is defined to mean a substantially flat, multi-sided structure forming a sealable pocket, with the pocket configured to receive an inserted object, such as for example, a letter, document, small part, jewelry and the like. The term "padded", as used herein, is defined to mean any structure used to cushion the contents of the envelope.

Referring now to the drawings, there is illustrated a padded shipping envelope assembly. Generally, the padded shipping envelope assembly includes a folded bladder disposed within a covering structure. The folded bladder contains a compressed, self-expanding padding material configured to expand when the bladder is pierced. The self-expanding padding material expands to a precompressed thickness, thereby providing protection to the shipping contents.

Figure 2:
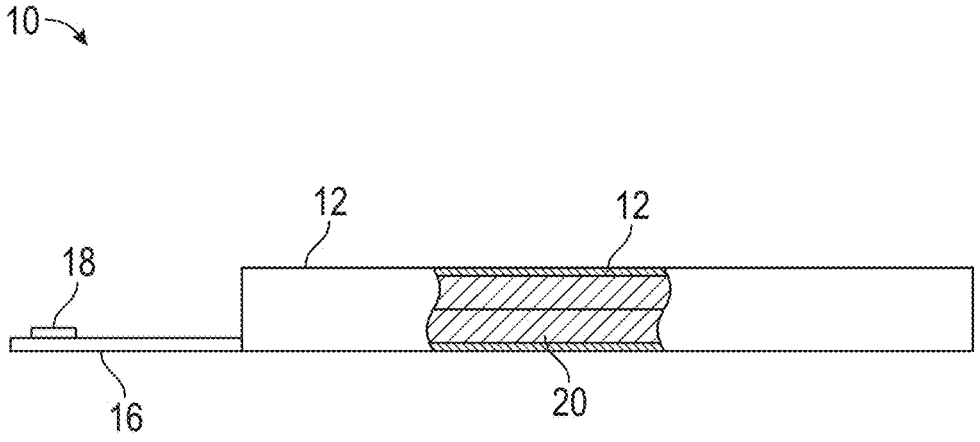
FIG. 2 is a side view, in elevation, of the padded shipping envelope assembly of FIG. 1.
Figure 3:
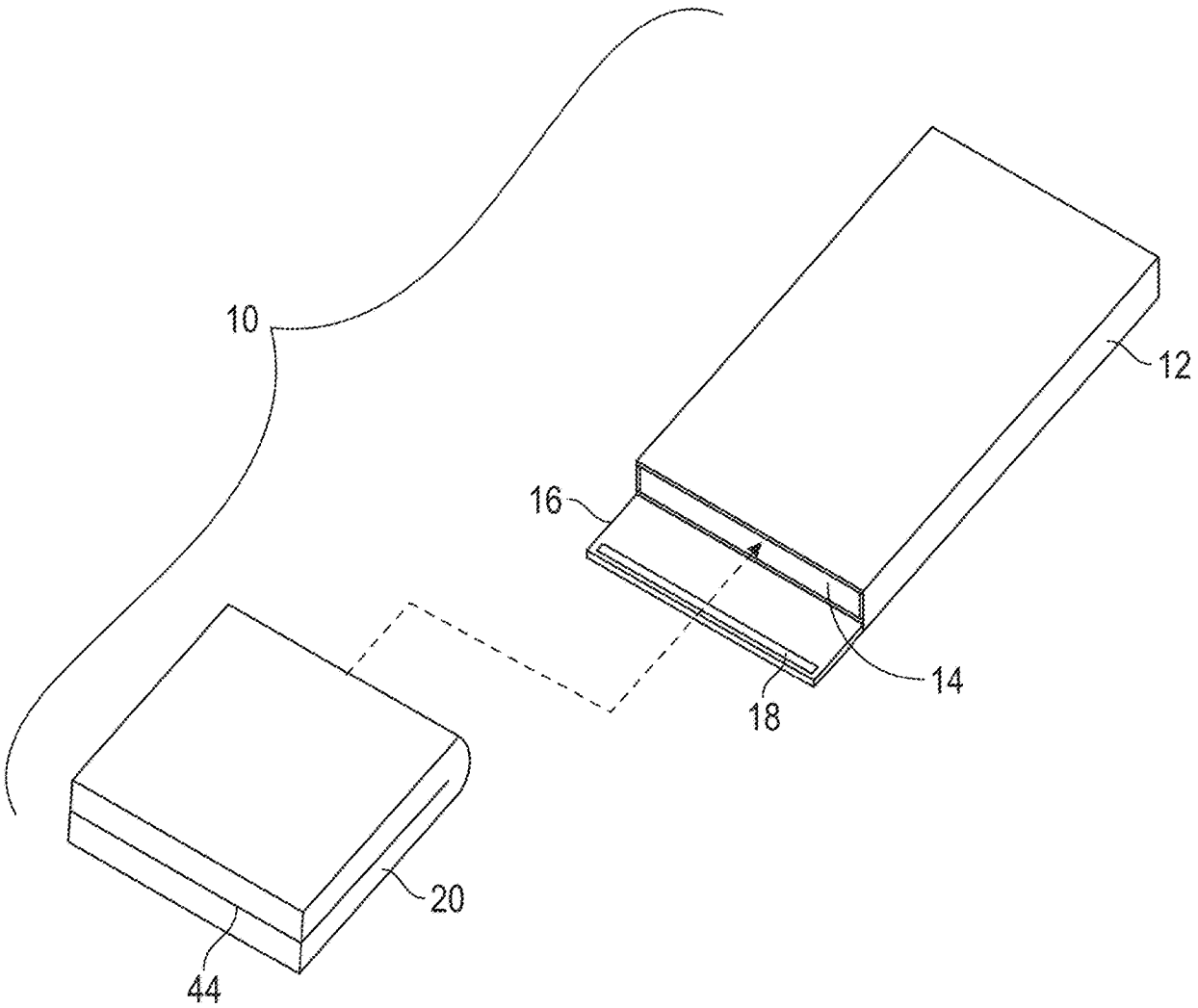
FIG. 3 is an exploded perspective view of the padded shipping envelope assembly of FIG. 1.

Referring now to FIGS. 1-3, a padded shipping envelope assembly (hereafter "padded envelope") is shown generally at 10. The padded envelop 10 includes a covering structure 12 configured to form an interior cavity 14. The covering structure 12 is conventional in the art and is configured to protect the contents of the interior cavity 14 from the effects of environmental elements. The covering structure 12 is further configured to provide abrasion resistance to the padded envelop 10. The covering structure 12 can be formed from a variety of materials or combinations of materials including the non-limiting examples of cardboard, corrugated paper and polymeric materials.

Referring again to FIGS. 1-3, the covering structure 12 includes a foldable sealing flap 16. The foldable sealing flap 16 is configured to enclose the interior cavity 14 after a folded, compressed bladder 20 has been inserted into the interior cavity 14. The folded, compressed bladder 20 will be discussed in more detail below. The foldable sealing flap 16 includes a closure mechanism 18 configured to secure the foldable sealing flap 16 in a closed orientation. In the illustrated embodiment, the closure mechanism 18 is an adhesive strip having a release tape. However, in other embodiments, the closure mechanism 18 can be other mechanisms, structures and devices sufficient to secure the foldable sealing flap 16 in a closed orientation.

Figure 4:
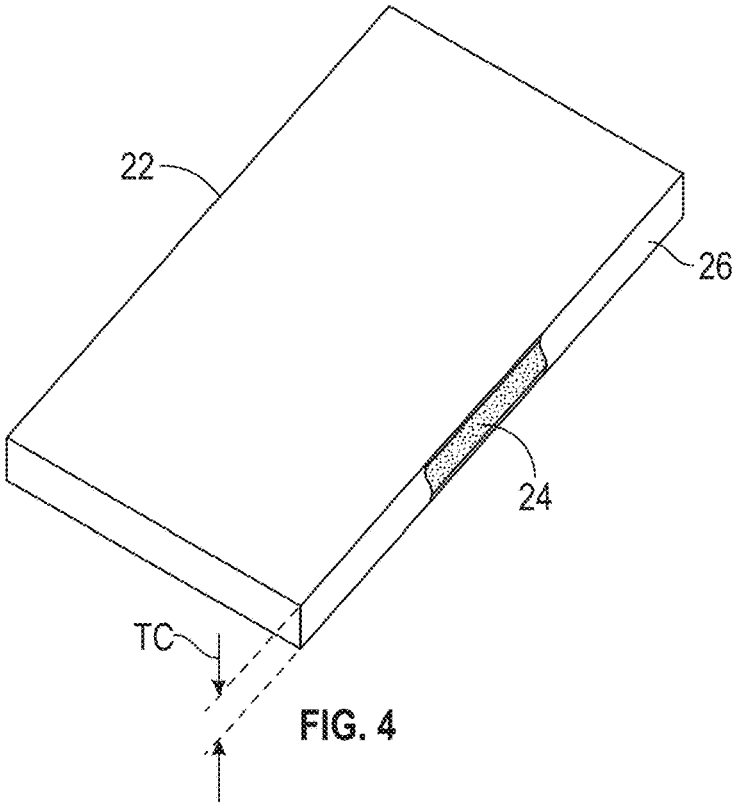
FIG. 4 is a perspective view of a compressed bladder of the padded shipping envelope assembly of FIG. 1.

Referring now to FIG. 4, a prefolded compressed bladder 22 is illustrated. The prefolded compressed bladder 22 forms a part of the folded, compressed bladder 20. The prefolded compressed bladder 22 includes a compressed, self-expanding padding material 24 that is disposed within an airtight flexible wrapper 26. The term "self-expanding" as used herein, is defined to mean the compressed padding material expands on its own after the airtight flexible wrapper 26 is pierced. In certain instances, the prefolded compressed bladder 22 is manufactured by initially compressing the compressible, self-expanding padding material 24 to remove most of the air therein, then subsequently sealing the compressed, self-expanding padding material 24 within the airtight flexible wrapper 26. The compressed, self-expanding padding material 24 remains compressed within the airtight flexible wrapper 26 until the airtight flexible wrapper 26 is later pierced or otherwise opened in a manner to allow ambient air to flow back into the compressed, self-expanding padding material 24, thereby resulting in an expansion of the compressed, self-expanding padding material 24 back to a precompressed volume.

Referring again to FIG. 4, the compressible, self-expanding padding material 24 has a precompressed thickness (not shown) and a compressed thickness TC. In the illustrated embodiment, the precompressed thickness is about 1.375 inches and the compressed thickness is about 0.31 inches. Accordingly, the compression ratio, which is the precompressed thickness divided by the compressed thickness is about 4.4. Without be held to the theory, it is believed the compression ratio of about 4.4 provides an optimum balance between the reduced storage volume of the prefolded compressed bladder 22 and the protection of the contents of the padded envelope 10. However, it should be appreciated that in other embodiments, the precompressed thickness can be more or less than about 1.375 inches, the compressed thickness can be more or less than about 0.31 inches and the resulting compression ratio can be more or less than about 4.4, sufficient to balance the reduced storage volume of the prefolded compressed bladder 22 and the protection of the contents of the padded envelope 10.

Referring to the embodiment illustrated in FIG. 4, the compressible, self-expanding padding material 24 is formed from polymeric foam, such as the non-limiting example of urethane foam. In other embodiments, the compressible, self-expanding padding material 24 can be formed from other materials or combinations of materials sufficient to be compressed and return to a precompressed volume following the introduction of air.

Referring to the embodiment illustrated in FIG. 4, while the compressible, self-expanding padding material 24 has been described above as being formed from polymeric foam, it is within the contemplation of the padded envelope 10 that the self-expanding padding material 24 could have other forms, such as the non-limiting example of a liquid form. It is contemplated that the self-expanding padding material 24 maintains its liquid form when sealed in the airtight flexible wrapper 26 and self-expands as a chemical reaction with air as the airtight flexible wrapper 26 is pieced.

Figure 5:
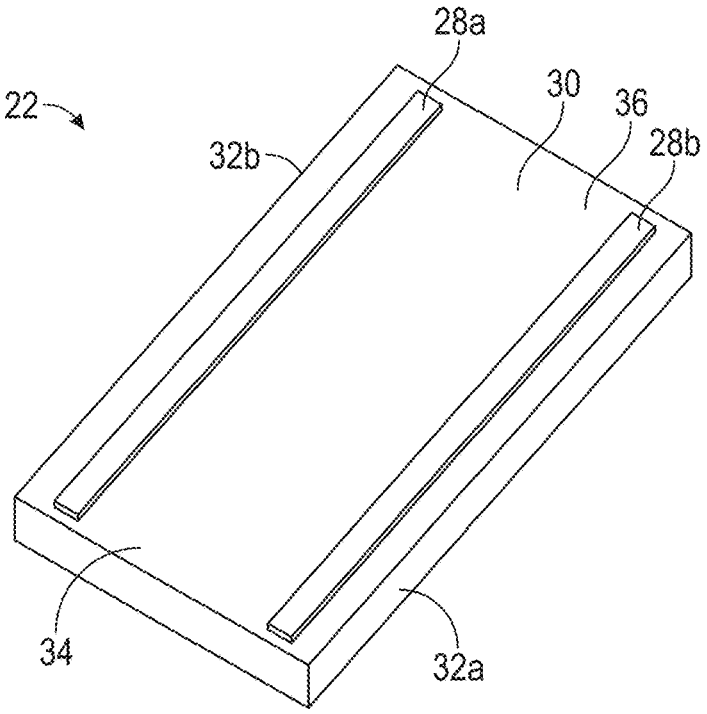
FIG. 5 is a perspective view of a compressed bladder of the padded shipping envelope assembly of FIG. 1 illustrated with adhesive tape strips.

Referring now to FIGS. 4 and 5, the prefolded compressed bladder 22 includes a plurality of adhesive, tape strips 28*a*, 28*b* applied to a major surface 30 of the prefolded compressed bladder 22. In the illustrated embodiment, each of the adhesive, tape strips 28*a*, 28*b* includes a flexible substrate (not shown) having adhesive applied to both sides thereof. If desired, a removable liner (not shown) may be applied to one or both sides of each of the adhesive, tape strips 28*a*, 28*b* prior to use. The adhesive, tape strips 28*a*, 28*b* are intended to be representative of any other structure that can retain the portions of the folded, compressed bladder 20 together as described below. As non-limiting examples, the portions of the folded, compressed bladder 20 can alternatively be retained together by a hot melt adhesive having no substrate or by conventional heat-sealing techniques. In the illustrated embodiment, the adhesive, tape strips 28*a*, 28*b* are applied adjacent to the longitudinal sides 32*a*, 32*b* of the prefolded compressed bladder 22. However, the adhesive, tape strips 28*a*, 28*b* may be applied at any desired locations on the major surface 30 of the prefolded compressed bladder 22.

Figure 6:
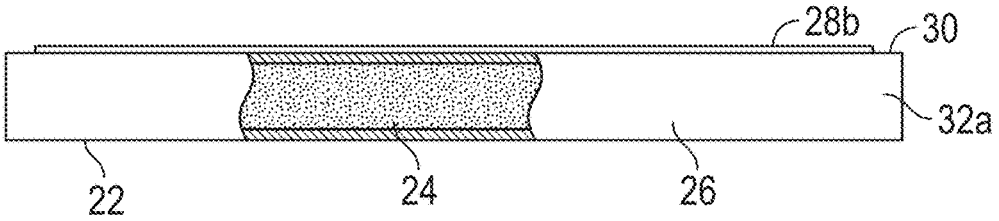
FIG. 6 is a side view, in elevation, of a compressed bladder of the padded shipping envelope assembly of FIG. 1 illustrated with adhesive tape strips.

Referring again to FIGS. 5 and 6, the prefolded compressed bladder 22 has a first end 34 and a second end 36. The first and second ends 34, 36 of the prefolded compressed bladder 22 will be discussed in more detail below.

Figure 7A:
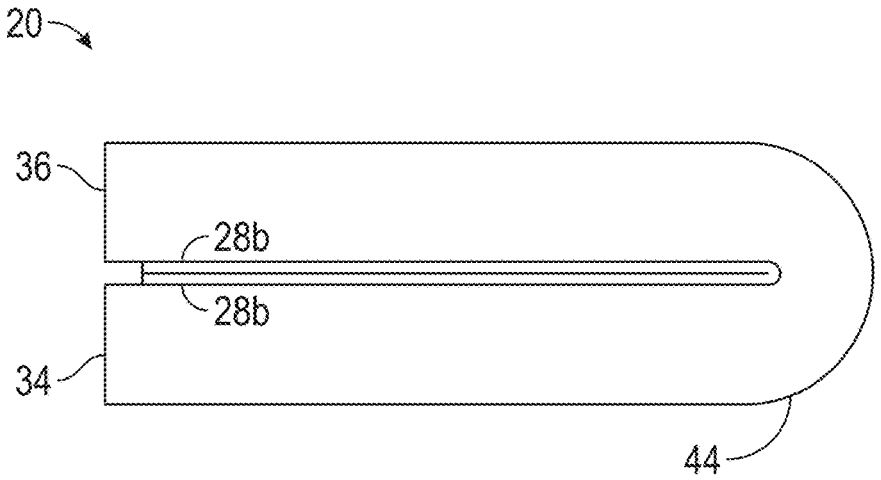
FIG. 7A is a side view, in elevation, of the folded, compressed bladder of the padded shipping envelope assembly of FIG. 1.
Figure 7B:
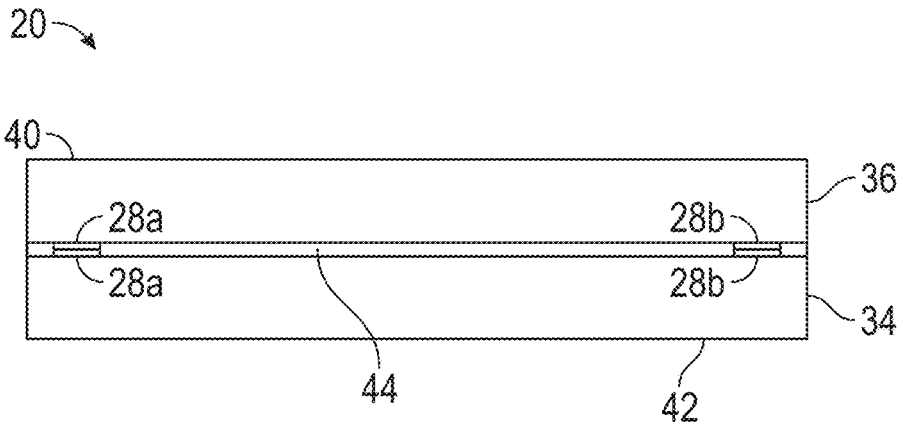
FIG. 7B is a front view, in elevation, of the folded, compressed bladder of the padded shipping envelope assembly of FIG. 1.

Referring now to FIGS. 7A and 7B, the prefolded compressed bladder 22 is shown in a folded orientation, thereby creating the folded, compressed bladder 20. In the folded orientation, the first and second ends 34, 36 are aligned with each other and overlapping portions of the adhesive, tape strips 28*a*, 28*b* engage one another in a manner such as to retain the folded, compressed bladder 20 in the folded orientation. Advantageously, in the folded orientation, the folded, compressed bladder 20 now functions as a padded pouch having three sealed sides. Referring now to FIG. 7B, the first sealed side 40 of the folded, compressed bladder 20 is formed by the sealed overlapping portions of the adhesive, tape strips 28*a*. Similarly, the second sealed side 42 of the folded, compressed bladder 20 is formed by the sealed overlapping portions of the adhesive, tape strips 28*b*. Referring now to FIG. 7A, the third sealed side of the folded, compressed bladder 20 is provided by the folded portion 44 of the folded, compressed bladder 20. Referring again to FIG. 7B, the three sealed sides of the compressed bladder 20 cooperate with the interior surfaces of the folded, compressed bladder 20 to define an interior bladder cavity 44 configured to receive one or more items for shipment.

Referring now to FIGS. 4, 5 the method of manufacturing the padded shipping envelope assembly as described as follows. Referring first to FIG. 4 in an initial step, a prefolded compressed bladder 22 is formed from a compressed, self-expanding padding material 24 disposed within an airtight flexible wrapper 26. Referring now to FIG. 5 in a next step, a plurality of adhesive, tape strips 28*a*, 28*b* are applied to a major surface 30 of the prefolded compressed bladder 22. Referring now to FIG. 7A in a next step, the prefolded compressed bladder 22 is folded over onto itself such that the first and second ends 34, 36 are aligned with each other and overlapping portions of the adhesive, tape strips 28*a*, 28*b* engage one another in a manner such as to retain the folded, compressed bladder 20 in the folded orientation. In this manner, the interior bladder cavity 44 is formed within the interior of the folded, compressed bladder 20. Further, in this manner, the folded, compressed bladder 20 is sealed on three sides. Referring now to FIG. 3 in a final manufacturing step, the folded, compressed bladder 20 is inserted into the interior cavity 14 of the covering structure 12 in a manner such that the interior bladder cavity 44 is accessible and adjacent the foldable sealing flap 16. The padded shipping envelope assembly is now ready for use. In use, an item intended for shipment is disposed in the cavity 14 and the covering structure 12 is subsequently pierced to allow air to reach the compressed, self-expanding padding material 24 such that the compressed padding material expands back to a precompressed thickness.

The principle and mode of operation of the padded shipping envelope assembly and method of manufacturing the padded shipping envelope assembly have been described in certain embodiments. However, it should be noted that the padded envelope assembly and method of manufacturing the padded envelope assembly may be practiced otherwise than as specifically illustrated and described without departing from its scope.

What is claimed is:

1. A padded shipping envelope assembly comprising:

a folded, compressed bladder configured to form an interior bladder cavity, the interior bladder cavity configured to receive items intended for shipment, the folded compressed bladder formed from a compressed, self-expanding padding material disposed in an airtight flexible wrapper, the folded compressed bladder being sealed on three sides with one side sealed by a folded portion, the folded portion extending between sealed longitudinal sides; and a covering structure having an interior cavity configured to receive the folded, compressed bladder and having a foldable sealing flap;

wherein the compressed padding material is configured to expand to a precompressed thickness upon the introduction of air.

2. The padded shipping envelope assembly of claim 1, wherein the compressed, self-expanding padding material has a compression ratio of about 4.4.

3. The padded shipping envelope assembly of claim 1, wherein the compressed, self-expanding padding material is formed from urethane foam.

4. The padded shipping envelope assembly of claim 1, wherein the folded compressed bladder is retained in a folded orientation by a plurality of adhesive strip tapes.

5. The padded shipping envelope assembly of claim 4, wherein the folded, compressed bladder has opposing ends and in the folded orientation, the opposing ends are aligned with each other.

6. The padded shipping envelope assembly of claim 1, wherein two of the three sealed sides of the folded, compressed bladder are formed by a plurality of adhesive strip tapes.

7. The padded shipping envelope assembly of claim 1, wherein in an assembled orientation, the interior bladder cavity is accessible and adjacent the foldable sealing flap.

8. A method of manufacturing a padded shipping envelope assembly comprising the steps of:

forming a compressed bladder from a compressed, self-expanding padding material disposed in an airtight flexible wrapper;

applying an adhesive material to a major surface of the compressed bladder;

folding the compressed bladder over onto itself such that the adhesive materials are engaged in a manner such that the folded, compressed bladder is maintained in a folded orientation, wherein in the folded orientation, the folded compressed bladder forms an interior bladder cavity that is sealed on three sides with one of the sides sealed by a folded portion, the folded portion extending between sealed longitudinal sides; and inserting the folded compressed bladder into a covering structure, thereby forming the padded shipping envelope assembly.

9. The method of claim 8, wherein the folded compressed bladder is retained in a folded orientation by a plurality of adhesive strip tapes.

10. The method of claim 8, wherein two of the three sealed sides of the folded, compressed bladder are formed by the adhesive material.

11. The method of claim 8, wherein the folded, compressed bladder has opposing ends and in the folded orientation, the opposing ends are aligned with each other.

12. The method of claim 8, wherein in an assembled orientation, the interior bladder cavity is accessible and adjacent the foldable sealing flap.

13. A folded, compressed bladder configured for use in a padded shipping envelope assembly, the folded compressed bladder comprising:

a flexible wrapper;

a compressed, self-expanding padding material disposed within the flexible wrapper; and an adhesive material applied to a major side of the flexible wrapper and configured to retain the folded, compressed bladder in a folded orientation;

wherein the folded, compressed bladder is sealed on three sides with one sealed by a folded portion extending between sealed longitudinal sides.

14. The folded, compressed bladder of claim 13, wherein the adhesive material is a plurality of adhesive strip tapes.

15. The folded, compressed bladder of claim 14, wherein the adhesive strip tapes are disposed adjacent to longitudinal sides of the folded, compressed bladder.

16. The folded, compressed bladder of claim 13, wherein two of the three sealed sides of the folded, compressed bladder are formed by the adhesive material.

17. The padded shipping envelope assembly of claim 13, wherein the folded, compressed bladder has opposing ends and in the folded orientation, the opposing ends are aligned with each other.

* * * * *